US008237539B2

(12) United States Patent
Bratkovski et al.

(10) Patent No.: US 8,237,539 B2
(45) Date of Patent: Aug. 7, 2012

(54) THERMISTOR

(75) Inventors: Alexandre M. Bratkovski, Mountain View, CA (US); Iakov Veniaminovitch Kopelevitch, Mountain View, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 160 days.

(21) Appl. No.: 12/899,759

(22) Filed: Oct. 7, 2010

(65) Prior Publication Data

US 2012/0086542 A1 Apr. 12, 2012

(51) Int. Cl.
*H01C 7/10* (2006.01)

(52) U.S. Cl. ..... 338/22 SD; 338/22 R; 252/511; 427/554

(58) Field of Classification Search ..... 338/22 SD, 338/22 R; 252/511–513, 519; 29/610.1; 427/554, 555

See application file for complete search history.

(56) References Cited

U.S. PATENT DOCUMENTS

| | | | | |
|---|---|---|---|---|
| 4,806,900 | A | 2/1989 | Fujimori et al. | |
| 5,081,438 | A * | 1/1992 | Nakahata et al. | 338/22 SD |
| 5,317,302 | A * | 5/1994 | Yamazaki | 338/22 SD |
| 5,378,407 | A * | 1/1995 | Chandler et al. | 252/513 |
| 5,488,350 | A * | 1/1996 | Aslam et al. | 338/22 SD |
| 5,982,271 | A * | 11/1999 | Handa | 338/22 R |
| 6,452,476 | B1 * | 9/2002 | Handa | 338/22 R |
| 6,778,062 | B2 | 8/2004 | Handa et al. | |
| 2010/0122976 | A1 | 5/2010 | Kim et al. | |

FOREIGN PATENT DOCUMENTS

| | | | |
|---|---|---|---|
| CN | 1546425 | A | 11/2004 |
| CN | 101407415 | A | 11/2008 |
| JP | 4039901 | A | 4/1992 |
| RU | 2008115787 | A | 10/2009 |

* cited by examiner

*Primary Examiner* — Kyung Lee

(57) ABSTRACT

A thermistor includes a multi-layer graphite structure having a basal plane resistivity that increases with increasing temperature; a substrate upon which the graphite structure is mounted; current and voltage electrodes attached to the graphite structure; current and voltage wiring; and a voltage measuring device to measure voltage out when current is applied to the thermistor.

20 Claims, 6 Drawing Sheets

THERMISTOR

BACKGROUND

A thermistor is a resistive device whose resistance varies with temperature changes. Thermistors are used as inrush current limiters, temperature sensors, self-resetting overcurrent protectors, and self-regulating elements. One specific application of thermistors is in instruments used for oil field exploration.

Because of their resistance-temperature dependence, thermistors are used as temperature sensors, and as such, thermistors typically achieve high precision relative to other temperature sensing elements, but do so within a limited temperature range, usually −90° C. to +130° C. However, platinum (Pt) thermistors are commercially available, and can be used at elevated temperatures, in the range of 500° C. to 700° C. More recently, semiconductors, including diamond-based semiconductors, have been considered for use in high temperature thermistors because of their thermal stability and an exponential temperature of the resistance, namely R(T) ~exp($E_a/k_BT$), where $E_a$ is the activation energy. However, at temperatures above 800° C., the diamond surface transforms to a graphite layer, thus limiting diamond-based semiconductor thermistor's temperature operational range to less than 800° C.

DESCRIPTION OF THE DRAWINGS

The Detailed Description will refer to the following drawings in which like numerals refer to like items, and in which.

DETAILED DESCRIPTION

Disclosed herein is a high temperature-range thermistor that can operate for extended periods in extreme temperature conditions—up to approximately 3,000° C. to 3,500° C. The high temperature-range thermistor is formed from graphite or multi-layer graphene (MLG). Such a graphite high temperature thermistor (GHTT) exhibits an exponential increase in in-plane resistivity with temperature increases. A GHTT can be used as a deep geothermic heat probe, in deep drilling applications, and as part of a borehole safety system. Graphite high temperature thermistors also can be used as sensors for volcanic activity.

The mineral graphite is one of the allotropes of carbon. Graphite is a layered compound. In each layer, the carbon atoms are arranged in a hexagonal lattice with separation of 0.142 nm, and the distance between planes is 0.335 nm. Unlike diamond (another carbon allotrope), graphite is an electrical conductor, a semimetal, and can be used, for instance, in the electrodes of an arc lamp. Highly ordered pyrolytic graphite or highly oriented pyrolytic graphite (HOPG) refers to graphite with an angular spread between the graphite sheets of less than 1°.

A GHTT may be manufactured from commercially available HOPG or MLG. In an example, a GHTT with tungsten (W) electrodes/wires can be used to monitor temperatures up to about 3400° C.

Figure 1:
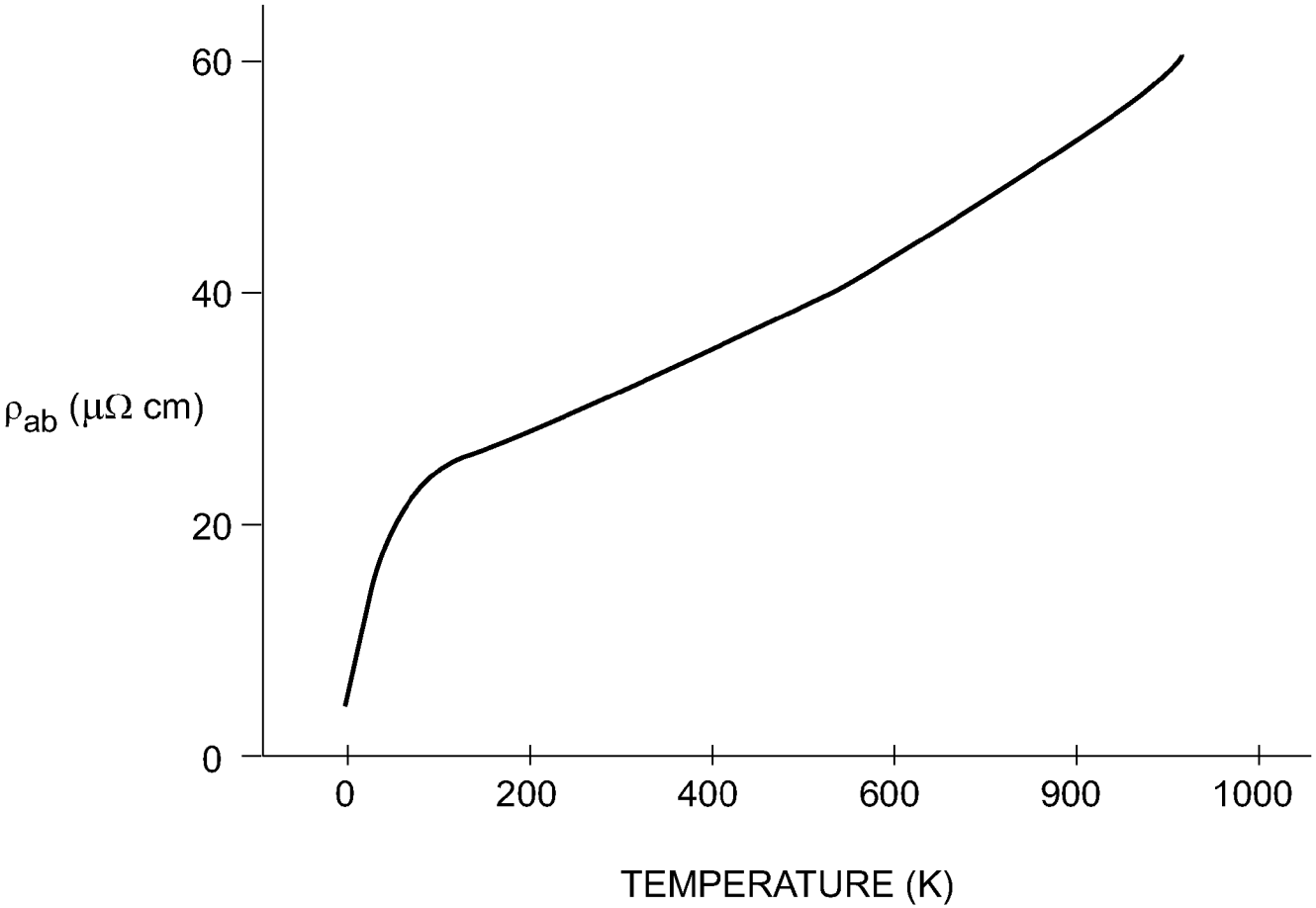
FIG. 1 illustrates basal-plane resistivity versus temperature for a highly oriented pyrolitic graphite (HOPG) sample.

FIG. 1 illustrates basal-plane resistivity versus temperature for a highly oriented pyrolitic graphite (HOPG) sample. In FIG. 1, temperature (K) is graphed versus resistivity ($\rho_{ab}$). As can be see from FIG. 1, resistivity and temperature exhibit a super-linear relationship above room temperature. That is, above room temperature, the resistivity-temperature relationship is not a direct, one-to-one relationship, and the slope of the line defining this relationship increases with increasing temperature.

The resistivity-temperature behavior of HOPG corresponds to the following empirically-derived equation:

$$\rho_{ab} = \frac{c}{e^2}\left(\frac{1}{\tau_o} + \alpha T\right)\frac{1}{\varepsilon^*} + \frac{c}{e^2 a_o T \tau}\exp\left(-\frac{\omega_o}{T}\right), \tag{1}$$

Equation 1 conforms to the data shown in FIG. 1. Equation 1 implies a super linear increase of resistivity above room temperature because of the exponential factor in the second term of the equation.

Figure 2:
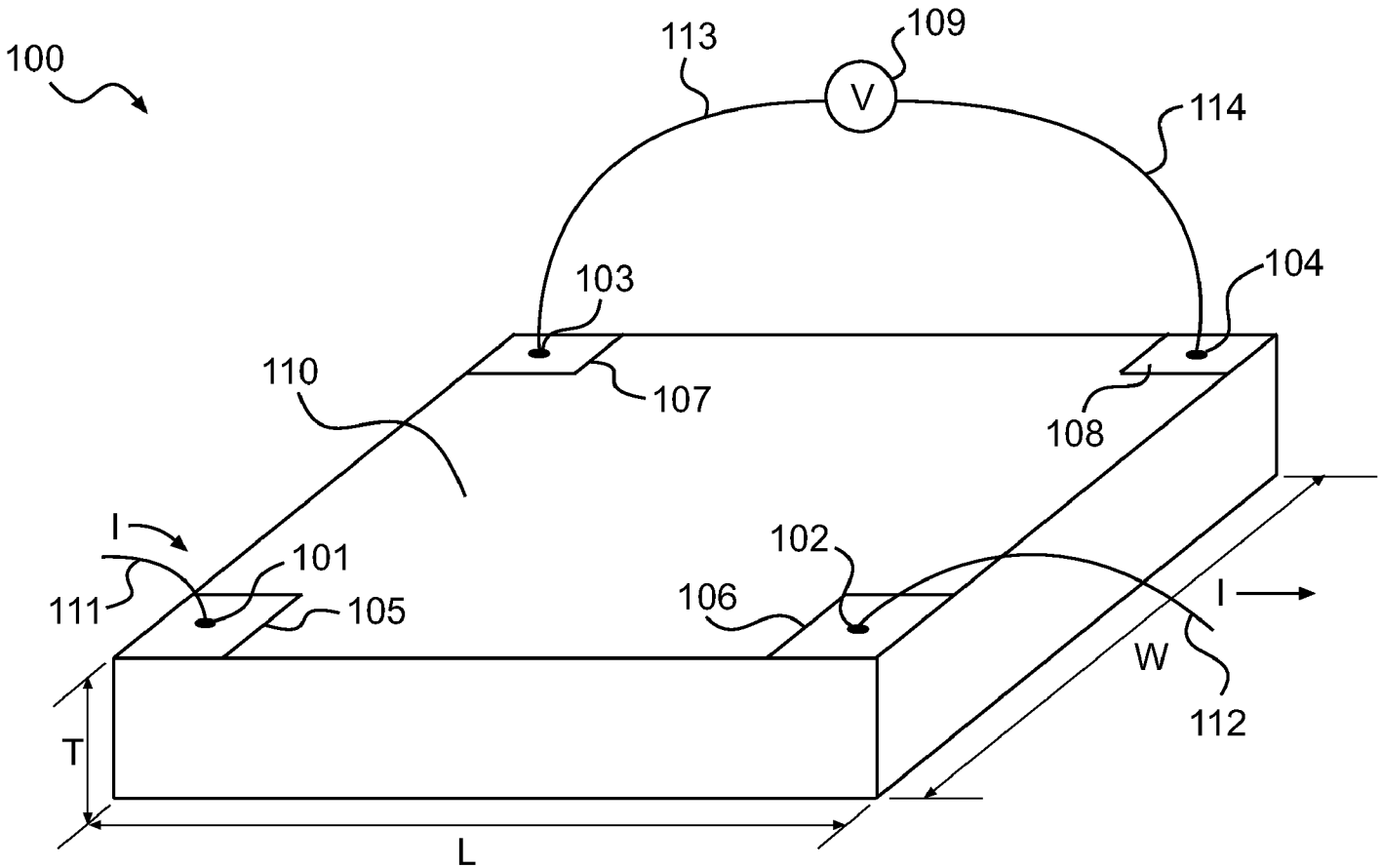
FIG. 2 illustrates an example of a thermistor.

FIG. 2 illustrates an example of a high temperature thermistor. In FIG. 2, thermistor 100 is seen to conform to the van der Pauw geometry. The thermistor 100 is generally square in shape and has dimensions of length and width of 1 millimeter and thickness of 0.1 millimeter. With this thickness, the thermistor 100 will consist of approximately 10,000 layers of graphene 110. The thermistor 100 can be formed to these dimensions by simple cleaving from a thicker sample of graphite. In another example, a thermistor of length 0.1 millimeters and width 0.1 millimeters can be formed with a thickness of about 100 angstroms, or 10 nanometers. This thinner example of a thermistor also may be formed by simple cleaving of a larger graphite sample. Either example may be mounted on a substrate, such as glass substrate (not shown) and packaged (packaging not shown) to protect the thermistor and its connections. To measure resistivity, a current is passed through the thermistor 100 and voltage measured using the usual van der Pauw method, as illustrated. Current electrodes 101 and 102 are used to pass the current through the thermistor 100 and voltage is measured at electrodes 103 and 104 using a suitable voltage measuring device 109. In an example, the electrodes 101-104 are clipped to the graphite base material. In the illustrated example, the electrodes 101-104 are attached to pads 105-108, which may be formed on the graphite surface by evaporation. The pads 105-108 are shown to have length and width approximately 1/10 the length and width of the thermistor layers 110. The electrodes are coupled to wires 111-114 for current and voltage. The material composition of the pads, electrodes, and wires may be dictated by the expected temperature in the environment in which the thermistor will be deployed. For high temperature environments, tungsten (W) may be used (the melting point of tungsten being about 3,400° C.). For other high temperature environment, including those exceeding the melting point of tungsten, the pads, electrodes, and wires may be fabricated from graphite. A specific graphite structure for these some of these applications in extremely high temperature environments is a carbon nano tube, and the wires may be in the form of bundles of carbon nano tubes or cutouts of carbon nano tube mats.

Using the thermistor of FIG. 2, after deployment in the desired environment, a current is passed through the thermistor 100 and its voltage is read. The voltage read then can be used to calculate resistivity. With resistivity known, temperature at the point of the thermistor 100 in its environment can be calculated according to Equation 1, or using a graph similar to that of FIG. 1.

Figure 3:
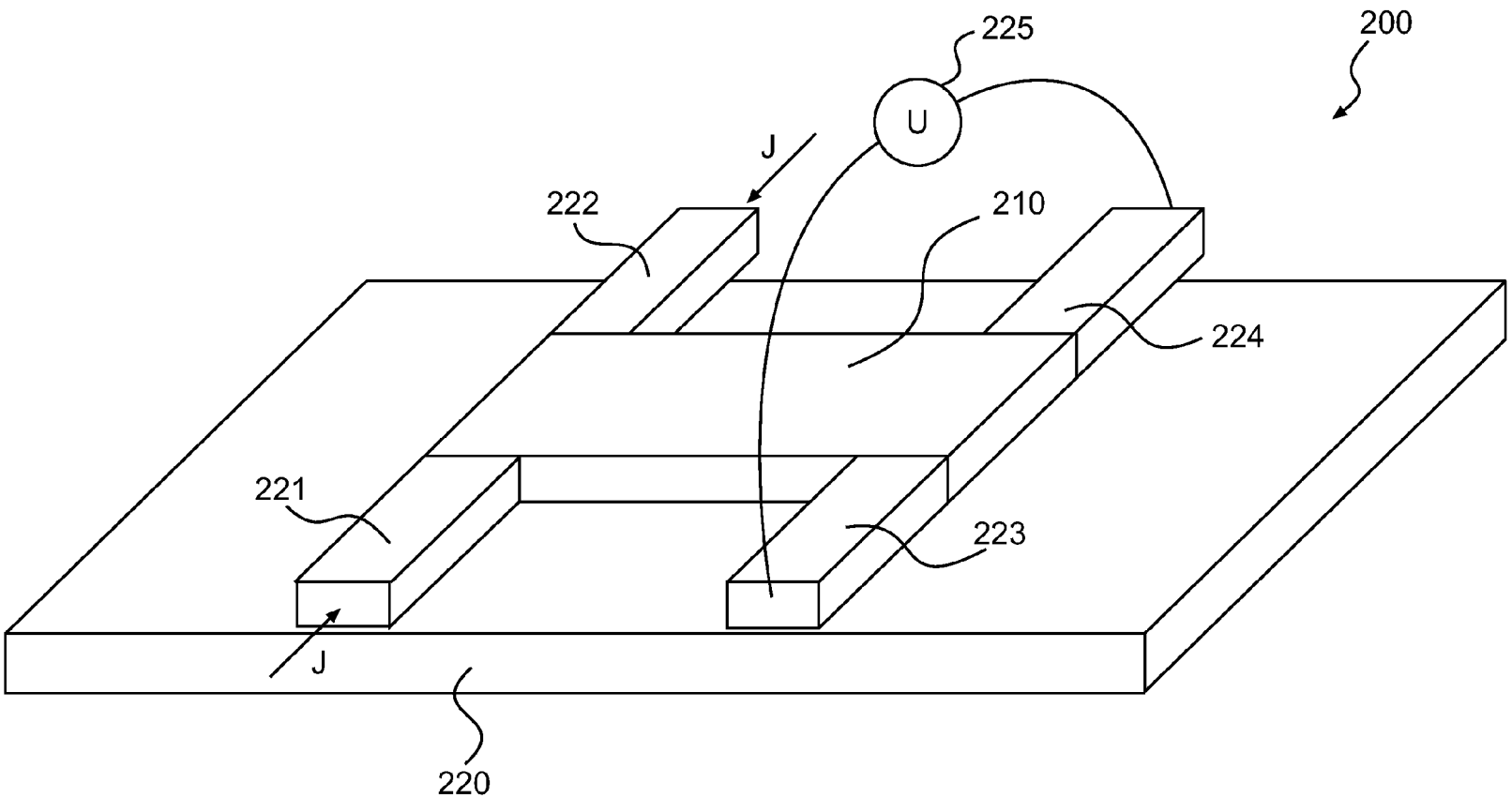
FIG. 3 illustrates another example of a thermistor.

FIG. 3 illustrates an alternate example of a thermistor that can be used in high temperature environments. In FIG. 3, thermistor 200 includes multi-layer graphite 210 supported by substrate 220. Depending on the use environment, the substrate 220 may be formed from glass, $SiO_2$, $AlO_2$, or graphite for example. Attached to the four corners of the graphite 210 are current electrodes 221 and 222, and voltage electrodes 223 and 224. Current is supplied to the electrodes 221 and 222 and voltage is read across the electrodes 223 and 224 using a suitable voltage sensor 225. The electrodes 221-224 may be formed from high-temperature conductors, such as tungsten, or from graphite, for very high temperature applications. Wires leading to/from the electrodes 221-224 similarly may be tungsten or graphite, depending on the expected temperature.

Figure 4:
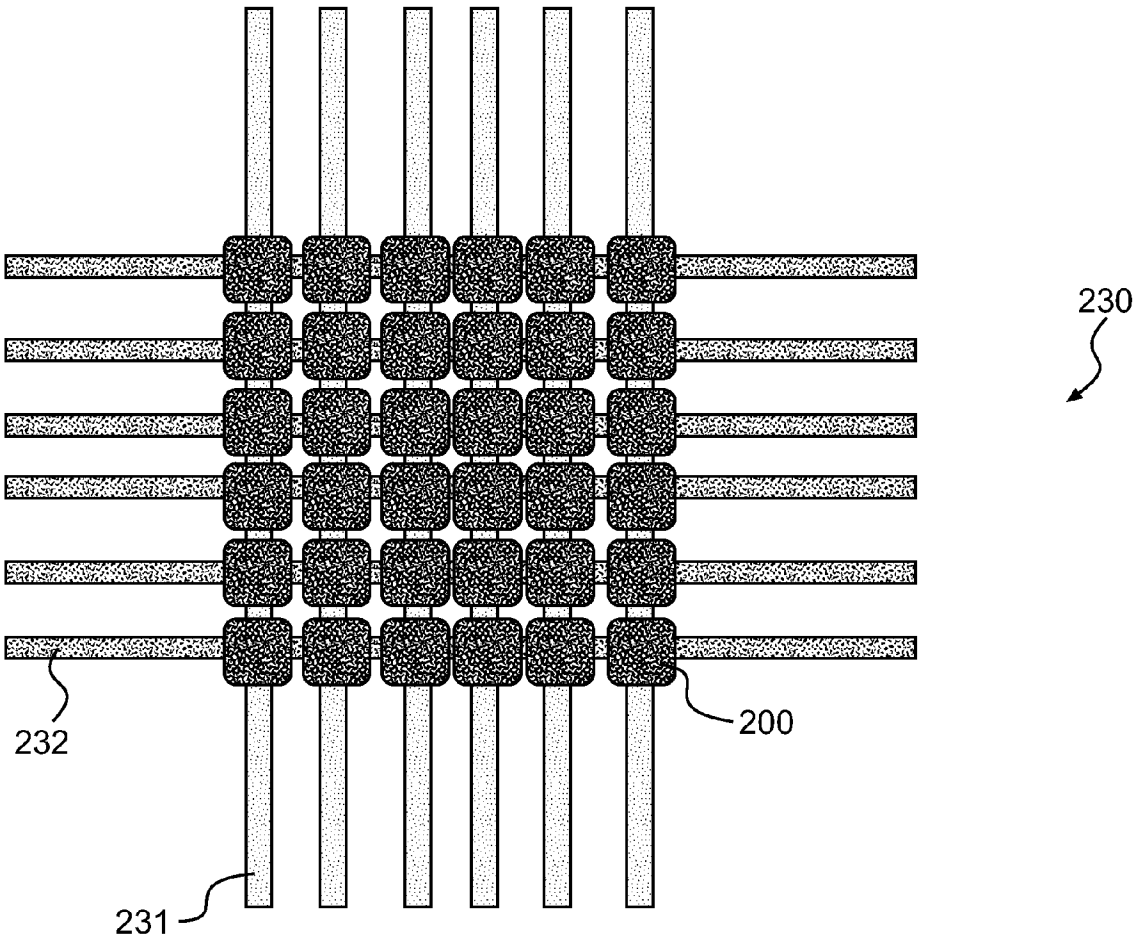
FIG. 4 illustrates a thermistor array.

FIG. 4 illustrates an example of an application of the thermistor 200 of FIG. 3 in a particular environment. As shown, thermistor array 230 includes a number of individual thermistors 200 arranged in an array format with corresponding current and voltage lines 231 and 232. The thermistor array 230 may be used to measure temperature gradients and distributions. The number of individual thermistors 200 in the array 230, and the spacing of the individual thermistors 200, will determine the size of the area measured and the granularity of the derived temperature gradients and distributions.

Figure 5:
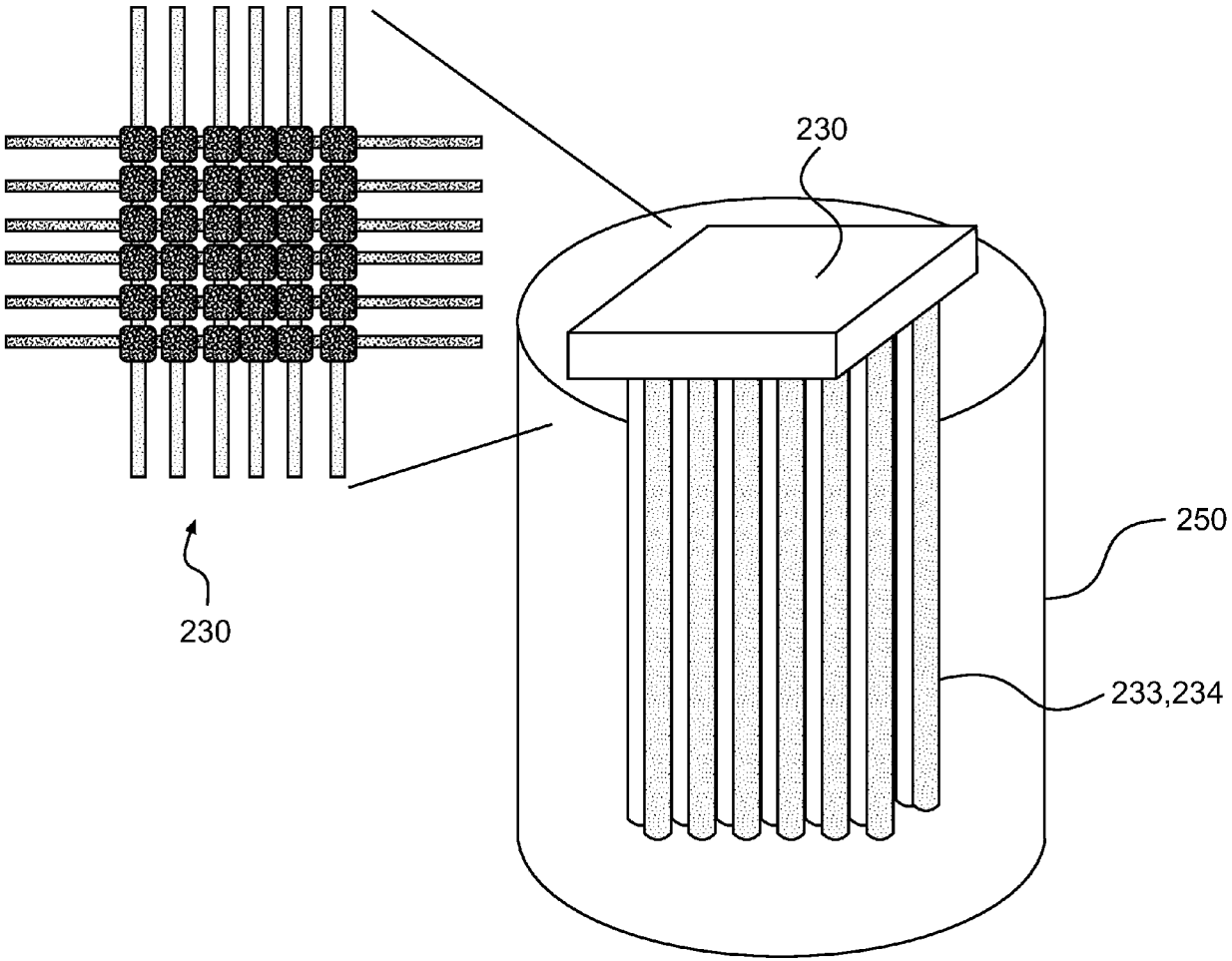
FIG. 5 illustrates a packaged thermistor array.

FIG. 5 illustrates a further application of the thermistor 200 of FIG. 2. In FIG. 5, thermistor array 230 is shown installed in packaging 250, which is intended to protect thermistor current and voltage wires 233 and 234.

Figure 6:
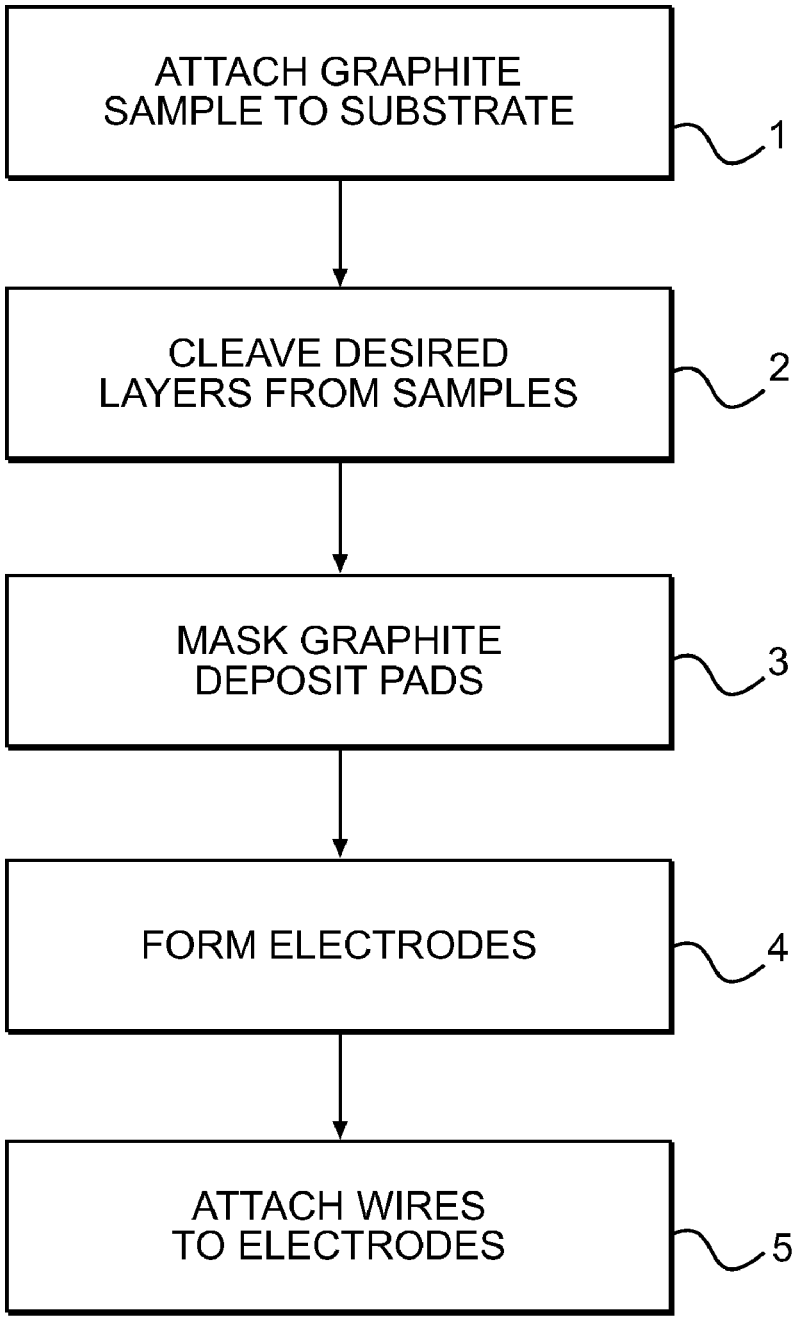
FIG. 6 illustrates an example for the manufacture of the thermistor of FIG. 2.

FIG. 6 illustrates an example for the manufacture of the thermistor of FIG. 2. In FIG. 6, block 1, graphite sample is attached to a substrate. In block 2, graphite layers 110 are cleaved from the graphite sample. In block 3, the graphite layers 110 are masked and electrode pads 105-108 are evaporated at the four corners of the graphite layers 110. In block 4, electrodes 101-104 are deposited on the pads. In block 5, current and voltage leads 111-114 are connected to the electrodes 101-104.

Example Use: Petroleum Exploration

The earth is a gigantic heat engine. A tremendous amount of heat is constantly transported from the earth's center to the surface by thermal convection and conduction. The geothermal heat is ultimately the driving force of most large-scale geologic processes that take place on the surface of the earth (e.g., movement of tectonic plates, volcanic eruptions, etc.). A portion of the heat conducted through the earth's crust is used to drive the chemical reactions which transform organic matter contained in sedimentary rocks into petroleum. Without the geothermal heat, there would be no naturally occurring petroleum. Therefore, measuring this heat and understanding its transport mechanisms through the crustal rocks are essential to the science of petroleum exploration, including offshore oil and gas exploration.

Geothermal heat flow through the seafloor is determined as a product of two separate measurements of the thermal gradient in, and the thermal conductivity of, the sediment in a depth interval. A single instrument can perform both measurements. A typical marine heat flow instrument is equipped with a thin (1-cm diameter) metal tube of 3- to 7-m length, which contains a dozen or more thermistors spaced along its length. The temperature data obtained at individual thermistors are stored in the digital data recorder in a pressure-proof housing attached at the top of the metal tube.

The instrument is lowered to the sea bottom by a winch cable from a ship. When the instrument reaches the seafloor, the thermal sensor tube penetrates vertically into the sediment and records the temperature continuously at each thermistor location. The sediment temperatures obtained at different sub-bottom depths define the geothermal gradient. To measure the geothermal gradient, about five to ten minutes after the penetration, the probe applies a calibrated, intense heat pulse to the surrounding sediment for about ten seconds. The temperature of the probe rises again quickly but falls after the termination of the heat pulse. The temperature decay is controlled by the thermal conductivity of the sediments. The heat dissipates relatively quickly through sediment of high thermal conductivity but slowly through low-conductivity sediment. Data from the thermal decay after the heat pulse allows the thermal conductivity to be calculated.

What is claimed is:

1. A thermistor, comprising:

a multi-layer graphite structure having a basal plane resistivity that increases with increasing temperature;

a substrate upon which the graphite structure is mounted;

current and voltage electrodes attached to the graphite structure;

current and voltage wiring; and a voltage measuring device to measure voltage out when current is applied to the thermistor.

2. The thermistor of claim 1, further comprising electrode pads formed between the graphite structure and the electrodes.

3. The thermistor of claim 1, wherein the electrodes are arranged in a van der Pauw geometry.

4. The thermistor of claim 1, wherein the substrate is formed from graphite.

5. The thermistor of claim 1, having a length of approximately 0.1 millimeter and a length of approximately 0.1 millimeter.

6. The thermistor of claim 5, wherein the multi-layer graphite structure comprises approximately 30 layers of graphene.

7. The thermistor of claim 1, having a length of approximately 1.0 millimeter and a width of approximately 1.0 millimeter.

8. The thermistor of claim 7, wherein the multi-layer graphite structure comprises approximately 10,000 layers of graphene.

9. The thermistor of claim 1, wherein the electrodes and wires are formed from tungsten.

10. The thermistor of claim 1, wherein the electrodes and wires are formed from graphite.

11. The thermistor of claim 10, wherein the wires are one of bundles of carbon nano tubes and cutouts of carbon nano tube mats.

12. The thermistor of claim 1, wherein the electrodes are mounted on the substrate.

13. The thermistor of claim 1, wherein a plurality of thermistors are arranged in an array to measure temperature gradient and distribution.

14. The thermistor of claim 1, wherein the thermistor is mounted in a shield to protect the current and voltage wiring.

15. A method for manufacturing a high-temperature thermistor, comprising:

attaching a graphite sample to a substrate;

cleaving a desired number of graphene layers from the graphite sample;

masking a surface of the cleaved graphene layers;

depositing electrode pads on the top surface; and attaching electrodes to the electrode pads and electrode leads to the electrodes.

16. The method of claim 15, wherein the electrodes and electrode leads are tungsten.

17. The method of claim 15, wherein the desired number of graphene layers is approximately 30.

18. The method of claim 15, wherein the graphite sample is highly oriented pyrolitic graphite (HOPG).

19. The method of claim 15, wherein the electrodes and the electrode leads are graphite.

20. The method of claim 15, wherein the electrodes are supported on the substrate.

* * * * *

UNITED STATES PATENT AND TRADEMARK OFFICE

CERTIFICATE OF CORRECTION

PATENT NO. : 8,237,539 B2
APPLICATION NO. : 12/899759
DATED : August 7, 2012
INVENTOR(S) : Alexandre M. Bratkovskl et al.

It is certified that error appears in the above-identified patent and that said Letters Patent is hereby corrected as shown below:

In column 5, line 4, in Claim 18, delete "pyrolitic" and insert -- pyrolytic --, therefor.

Signed and Sealed this
Ninth Day of April, 2013

Teresa Stanek Rea
*Acting Director of the United States Patent and Trademark Office*